US006069438A

United States Patent [19]

Okamoto

[11] Patent Number: 6,069,438

[45] Date of Patent: May 30, 2000

[54] COLOR CATHODE RAY TUBE WITH CONVERGENCE MAGNET

[75] Inventor: Hisakazu Okamoto, Kumagaya, Japan

[73] Assignee: Kabushiki Kaisha Toshiba, Kawasaki, Japan

[21] Appl. No.: 09/095,052

[22] Filed: Jun. 10, 1998

[30] Foreign Application Priority Data

Jun. 10, 1997 [JP] Japan ..... 9-152204

[51] Int. Cl.[7] ..... G04L 3/42

[52] U.S. Cl. ..... 313/442; 313/431; 335/210; 335/211

[58] Field of Search ..... 313/412, 413, 313/426, 430, 431, 433, 440, 442; 335/210, 211, 212

[56] References Cited

U.S. PATENT DOCUMENTS

| | | | |
|---|---|---|---|
| 5,557,164 | 9/1996 | Chen et al. | 313/440 |
| 5,708,323 | 1/1998 | Okamoto | 313/431 |

FOREIGN PATENT DOCUMENTS

| | | | |
|---|---|---|---|
| 0 633 598 | 1/1995 | European Pat. Off. | H01J 29/70 |
| 0 643 413 | 3/1995 | European Pat. Off. | H01J 29/70 |

*Primary Examiner*—Michael H. Day

*Attorney, Agent, or Firm*—Pillsbury Madison & Sutro LLP

[57] ABSTRACT

A color CRT including an envelope having a tube axis (Z) and including panel (21) having an inner surface on which a phosphor screen (23) is formed, a funnel (22) connected to the panel (21) and neck (25) connected to the funnel (22), an electron gun assembly (40) arranged in the neck (25) for emitting three in-line electron beams toward the phosphor screen (23), convergence magnetic structure (32) arranged outside of the neck (25) for generating a hexapole magnetic field in the neck (25), a first pair of magnetic members (33A, 33B) arranged outside of the neck on a horizontal axis faced to each other with the electron gun interposed therebetween and extending along the axis of the tube; and a second pair of magnetic members (60A, 60B) so arranged in the X-Y plane as to face each other on a Y-axis and elongated along the magnetic structure (32), respectively, the X-axis corresponding to the horizontal axis, the Y-axis corresponding to the vertical axis normal to the tube axis (Z). The first pair of magnetic members (33A, 33B) extending along the axis of the tube to shield the in-line electron beams from external magnetic fields. The second pair of magnetic members (60A, 60B) are arranged on an inner surface of a ring shaped hexapole magnetic plate 30 symmetrically near the Y-axis. The above arrangement reduces the effect of the magnetic force on the center beam without reducing the effect of the magnetic force on the two side beams in order to minimize the undesired displacement of the center beam.

11 Claims, 7 Drawing Sheets

COLOR CATHODE RAY TUBE WITH CONVERGENCE MAGNET

BACKGROUND OF THE INVENTION

This invention relates to a color cathode ray tube and, more particularly, it relates to an in-line type color cathode ray tube comprising an in-line type electron gun assembly and showing an improved convergence characteristic.

Generally, an in-line type color cathode ray tube comprises an envelope including a panel 1 and a funnel 2 connected to the panel 1 as shown in FIGS. 1 and 2. A fluorescent screen 3 is arranged on the inner surface of the panel 1, said fluorescent screen 3 having three layers of red (R), green (G) and blue (B) fluorescent materials laid on the inner surface of the panel 1. Additionally, a shadow mask 4 is arranged vis-a-vis the fluorescent screen 3 in close vicinity.

An in-line type electron gun assembly is arranged in the neck 5 of the funnel 2 of the tube and adapted to emit in-line three electron beams.

Additionally, a deflector 6 is arranged around the tube to partly cover the funnel 2 and the neck 5 and a dipole magnet 7 having an N-pole and an S-pole is disposed behind the deflector 6. The dipole magnet 7 is used to regulate the landing beams.

A convergence magnet 8 is arranged outside the neck 5 and comprises at least a pair of ring-shaped magnet plates 11 for generating a quadrupole static magnetic field with two pairs of N- and an S-poles and another pair of ring-shaped magnet plates 10 for generating a hexapole static magnetic field with three pairs of N- and S-poles.

Thus, when the deflector is at rest, the dipole magnet 7 and the convergence magnet 8 converge the three electron beams of a green electron beam operating as center beam and red and blue electron beams operating as side beams that are emitted from the electron gun in array to the center of the fluorescent screen 3 to achieve a satisfactory level of color purity and convergence.

The three electron beams are then deflected by the deflector 6 to scan the fluorescent screen to reproduce the transmitted color image on the fluorescent screen 3.

Since the cathode of the electron gun of an in-line type color cathode ray tube of the above described type is made of a magnetic material, it is apt to be affected by various external magnetic fields including the geomagnetism. Additionally, it is subjected to a different set of external magnetic conditions if it is angularly displaced from the regulated state or used in an geographical area having geomagnetic conditions that are different from those of the area for which it is designed. If, for example, an external magnetic field such as the geomagnetism enters the neck with a component transversal relative to the axis of the color cathode ray tube, the side beams of the three electron beams are subjected to respective forces that are oppositely directed relative to each other. In other words, the side beams are subjected to respective vertical forces, one of which is positively directed relative to the Y-axis while the other is negatively directed relative to the Y-axis so that consequently the red image and the blue image displayed on the fluorescent screen by the side beams can be displaced vertically relative to each other. Thus, a pair of elongated magnets 9 are typically arranged outside the neck oppositely relative to each other on the horizontal axis of the neck and extending along the axis of the tube in order to shield the electron beams against the external magnetic field.

As shown in FIG. 2, the magnets 9 are held in contact with the inner surface of a hollow cylindrical holder H of the convergence magnet 8 and rigidly fitted thereto along the axis of the tube in order to keep them close to the loci of the electron beams in the tube as much as possible.

On the other hand, the hexapole magnet plate 10 generates a magnetic field having a distribution pattern as shown in FIG. 3 by the six N- and S-poles arranged alternately at regular intervals on the ring-shaped magnet plate. Due to the distribution pattern, the magnetic field applies forces to the outer electron beams, or side beams, respectively along a same direction to change the tracks of the side beams. On the other hand, all the forces caused by the magnetic field are set off at central axis of the color cathode ray tube, which agrees with the locus of the center beam, so that the latter is not subjected to any force that can change its course.

As described above, as a convergence magnet for producing a static magnetic field for correcting the loci of the three electron beams and magnets for shutting off external magnetic fields are arranged within the limited area of neck of the color cathode ray tube, the magnets and the magnet plates partly overlap each other along the axis of the tube.

Then, as the magnets and the magnet plates are located close to each other, the magnets can be magnetized further by magnetic poles of the magnet plates, particularly, by those of the hexapole magnet plates.

FIG. 4A of the accompanying drawing shows the distribution pattern of the magnetic field that can be produced by the hexapole magnet plate to correct the electron beams upwardly relative to the vertical axis or in the positive direction of the Y-axis. Note that the positive and negative directions as used herein refers to the direction of the arrow and the opposite direction respectively for both the Y-axis and the X-axis in FIG. 4A.

Referring to FIG. 4A, the N- and S-poles of the hexapole magnet plate 10 are arranged symmetrically on the horizontal axis, or X-axis. Then, the magnets 9A and 9B oppositely disposed on the X-axis are located close to one f the N-poles and one of the S-poles respectively. Thus, as shown in the enlarged partial view in FIG. 4B, the areas of the magnets 9A and 9B located close to the corresponding poles of the hexapole magnet plate 10 respectively will be magnetizes oppositely relative to the polarity of the respective poles of the hexapole magnet plate. Meanwhile, the entire magnets are magnetized along the longitudinal direction, or along the Z-axis, so that consequently each of the magnets give rise to a dipole magnetic field both at the front end, or the end close to the magnet plate, and the rear end. More specifically, an S-pole appears on the surface of the magnet 9A located close to an N-pole of the magnet plate and an N-pole appears on both the front end and the rear end of the magnet 9A, which is arranged on the positive side of the X-axis. Likewise, an N-pole appears on the surface of the magnet 9B located close to an S-pole of the magnet plate and an S-pole appears on both the front end and the rear end of the magnet 9B, which is arranged on the negative side of the X-axis.

Thus, a magnetic field directed from the magnet 9A toward the magnet 9B or from the positive side toward the negative side of the X-axis is generated at the rear end of the magnet 9A and that of the magnet 9B. The generated magnetic field then exerts an upward force on the electron beams passing by the rear ends of the magnets.

Additionally, as the magnetic flux of each of the poles of the magnet plate 10 located on the X-axis is guided by the magnets, the magnetic field generated by the magnet plate 10 and directed from the positive side toward the negative side on the X-axis will be damped. As described above, while the magnet plate 10 is so designed that the magnetic field intensity is reduced to zero on the track of the center beam due to the equilibrated intensities of the magnetic fields of the two poles arranged on the horizontal axis and the four poles located close to the Y-axis without using the magnets, the intensity of the magnetic field generated by the four poles of the magnet plate 10 and directed from the positive side toward the negative side of the X-axis becomes relatively strong when the magnets are arranged because of the damped intensity of the magnetic field on the X-axis. In other words, while a magnetic field is generated and directed from the positive side toward the negative side at the front end as well as at the rear end of each of the magnets, a magnetic field directed from the negative side toward the positive side of the X-axis exists as a total effect of the magnetic fields on the track of the center beam because of the magnetic field generated by the four poles near the Y-axis and directed from the negative side toward the positive side of the X-axis.

Therefore, a magnetic field that is directed from the positive side toward the negative side of the X-axis is generated near the magnet plate 10 on the tracks of the side beams whereas a magnetic field that is directed from the negative side toward the positive side of the X-axis is generated on the track of the center beam. Thus, the two magnetic fields are directed oppositely on the tracks of the side beams and the center beam.

Then, as for the effect of the magnetic fields on the electron beams as observed on the surface of the magnet plate, the side beams are subjected to an upward electromagnetic force, whereas the center beam is subjected to a downward electromagnetic force.

As a result, if the tracks of the electron beams are regulated for a hexapole magnet plate adapted to displace the two side beams by 1.3 mm toward the positive side of the Y-axis in such a way that the center beam is not displaced when no magnets are arranged, then, once the magnets are arranged, the two side beams will be displaced toward the positive side of the Y-axis by 0.5 mm while the center beam will be displaced toward the negative side of the Y-axis by 0.8 mm.

Thus, not only the operability of the magnet plate will be adversely affected by the dipole magnets but also a displacement of the center beam will occur if the six poles are corrected after the operation of regulating the landing beams by means of the dipole magnets so that the regulating operation will have to be repeated to reduce the efficiency of the overall regulating operation.

As discussed above, a known color cathode ray tube is accompanied by a problem that the two side beams show a reduced displacement and the center beam is displaced oppositely relative the side beams in the operation of vertically correcting the tracks of the electron beams for the arrangement of magnets.

BRIEF SUMMARY OF THE INVENTION

An object of the present invention is to provide a color cathode ray tube showing an enhanced level of controllability and providing an excellent regulating efficiency.

According to a first aspect of the invention, there is provided a color cathode ray tube comprising:

an envelope having a tube axis and including a panel having an inner surface on which a phosphor screen is formed, a funnel connected to the panel and neck connected the funnel;

an electron gun assembly, arranged in the neck, for emitting in-line three electron beams toward the phosphor screen;

convergence magnet structure arranged outside of the neck, for generating a hexapole magnetic field in the neck;

a first pair of magnetic members arranged outside of the neck on a horizontal axis, faced to each other with the electron gun assembly interposed therebetween and extending along the axis of the tube; and a second pair of magnetic members so arranged in the X-Y plane as to face to each other on a Y-axis and elongated along the magnet structure, respectively, the X-axis corresponding to the horizontal axis, the Y-axis corresponding to a vertical axis normal to the horizontal axis and the tube, axis and the X-Y plane being defined by the X- and Y-axis.

According to a second aspect of the invention, there is provided a color cathode ray tube comprising:

an envelope having a tube axis and including a panel having an inner surface on which a phosphor screen is formed, a funnel connected to the panel and neck connected the funnel;

an electron gun assembly arranged in the neck, for emitting in-line of electron beams toward the phosphor screen;

an convergence magnet structure arranged outside of the neck, for generating a hexapole magnetic field in the neck;

a first pair of magnetic members arranged outside of the neck on a horizontal axis, faced to each other with the electron gun interposed therebetween and extending along the axis of the tube; and a second pair of magnetic members so arranged in the X-Y plane as to face to each other on a Y-axis each having a shape being symmetrically relative to the X-Z plane and elongated along the magnet structure within an angle between 25° and 40° of a circle with the center located on the tube axis in the X-Y plane, the X-axis corresponding to the horizontal axis, the Y-axis corresponding to a vertical normal to the horizontal axis and the tube axis, a Z-axis corresponding to the tube axis, the center being defined as the point of intersection of the X-, Y- and Z-axes.

With a color cathode ray tube according to the invention, a pair of second magnets are arranged on the X-Y plane discontinuously relative to the first magnets to cover a predetermined area near the Y-axis, where the X-axis is the horizontal axis in the vicinity of the magnet plate and the Y-axis is a vertical axis rectangularly intersecting the horizontal axis and the axis of the tube. More specifically, a second pair of magnets arranged on the X-Y plane symmetrically relative to the X-Z plane to cover an angle near the Y-axis between 25° and 40° of a circle with the center located at the original point, where the Z-axis is the axis of the tube and the original point is defined as the point of intersection of the X-, Y- and Z-axes.

Thus, with the above arrangement, the effect of the magnetic field affecting the center beam can be suppressed to reduce any undesired displacement of the center beam without reducing the intensity of the magnetic field affecting the side beams of a plurality of electron beams emitted from the electron gun.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Now, a color cathode ray tube, a color cathode ray tube comprising an in-line type electron gun assembly in particular, according to the invention will be described by referring to the accompanying drawing that illustrates a preferred embodiment of the invention.

Figure 1:
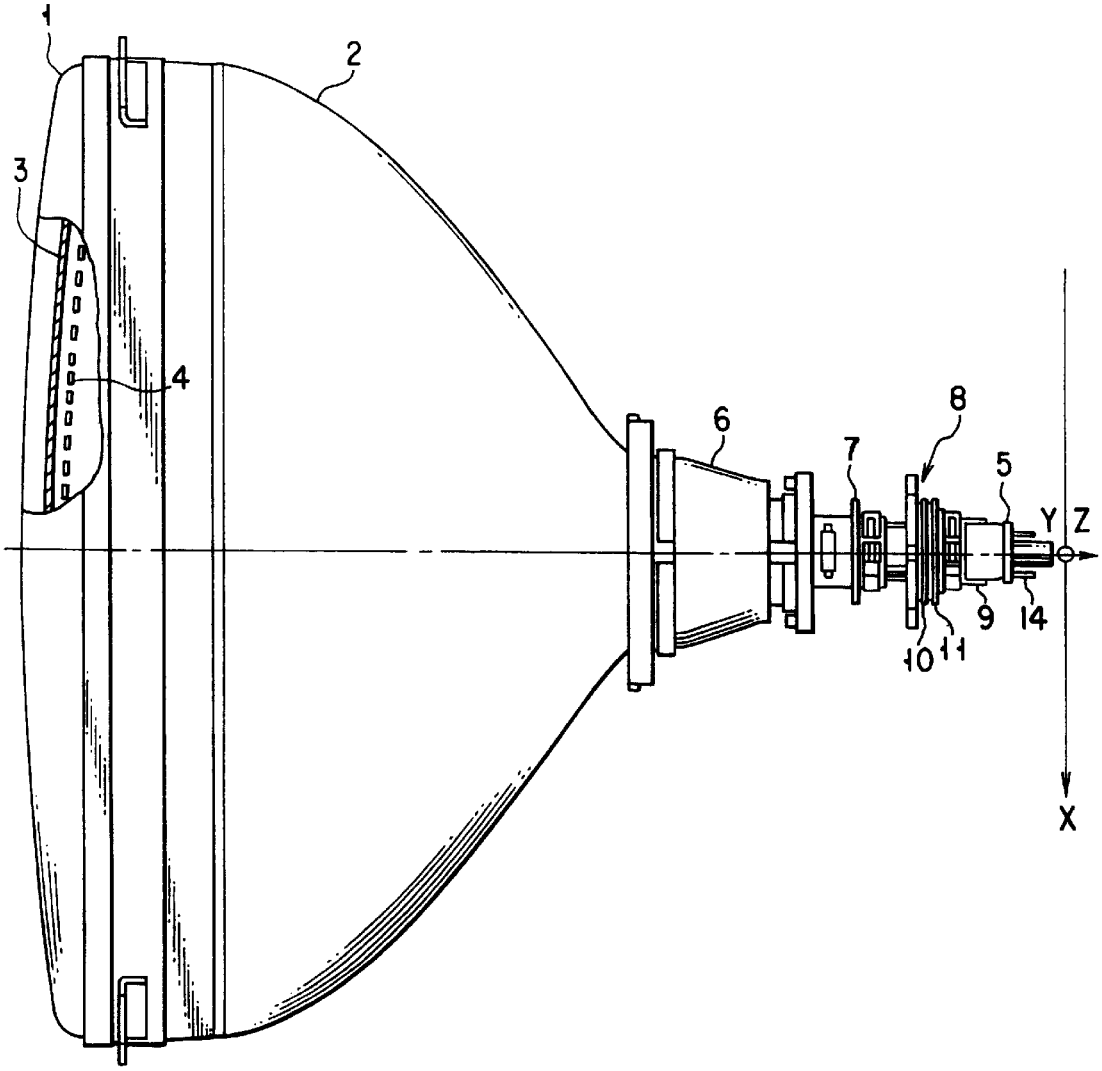
FIG. 1 (PRIOR ART)
FIG. 1 is a schematic lateral view of a known in-line type color cathode ray tube, showing its overall configuration.
Figure 2:
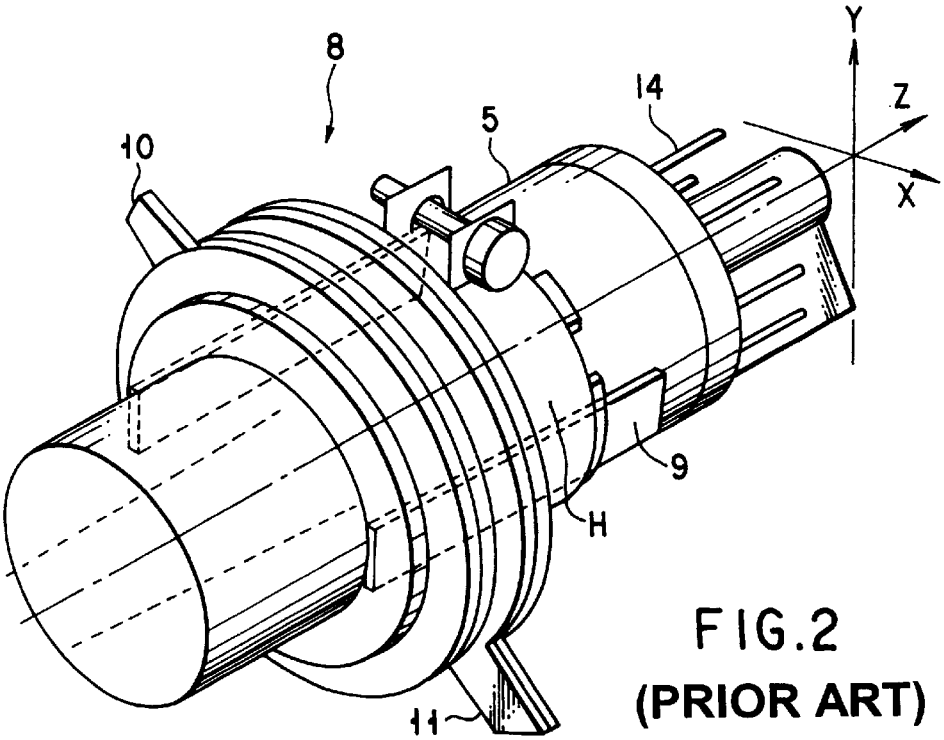
FIG.2 (PRIOR ART)
FIG. 2 is a schematic perspective view of the convergence magnet of the in-line type color cathode ray tube of FIG. 1.
Figure 3:
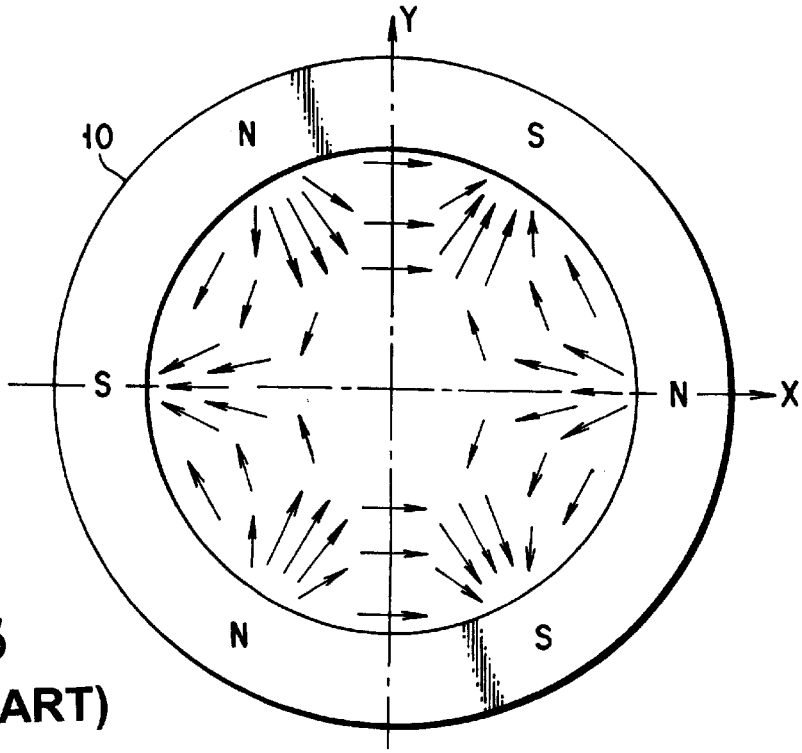
FIG.3 (PRIOR ART)
FIG. 3 is a schematic illustration of the distribution pattern of the magnetic field produced by the hexapole magnet plate of FIG. 2.
Figure 4A:
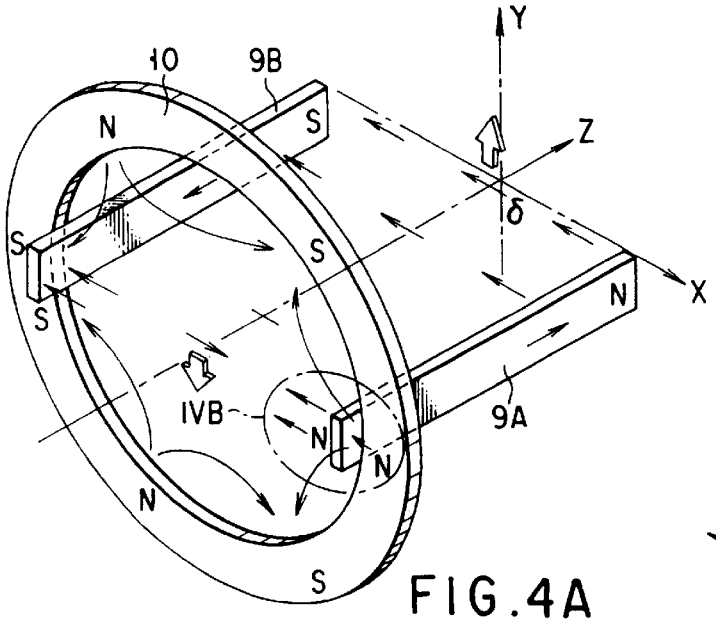
FIG.4A (PRIOR ART)
FIGS. 4A and 4B are schematic perspective views of the convergence magnet and the magnets of FIG. 2, showing their positional relationship.
Figure 4B:
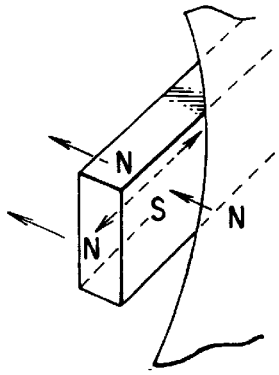
FIG.4B (PRIOR ART)
Figure 5:
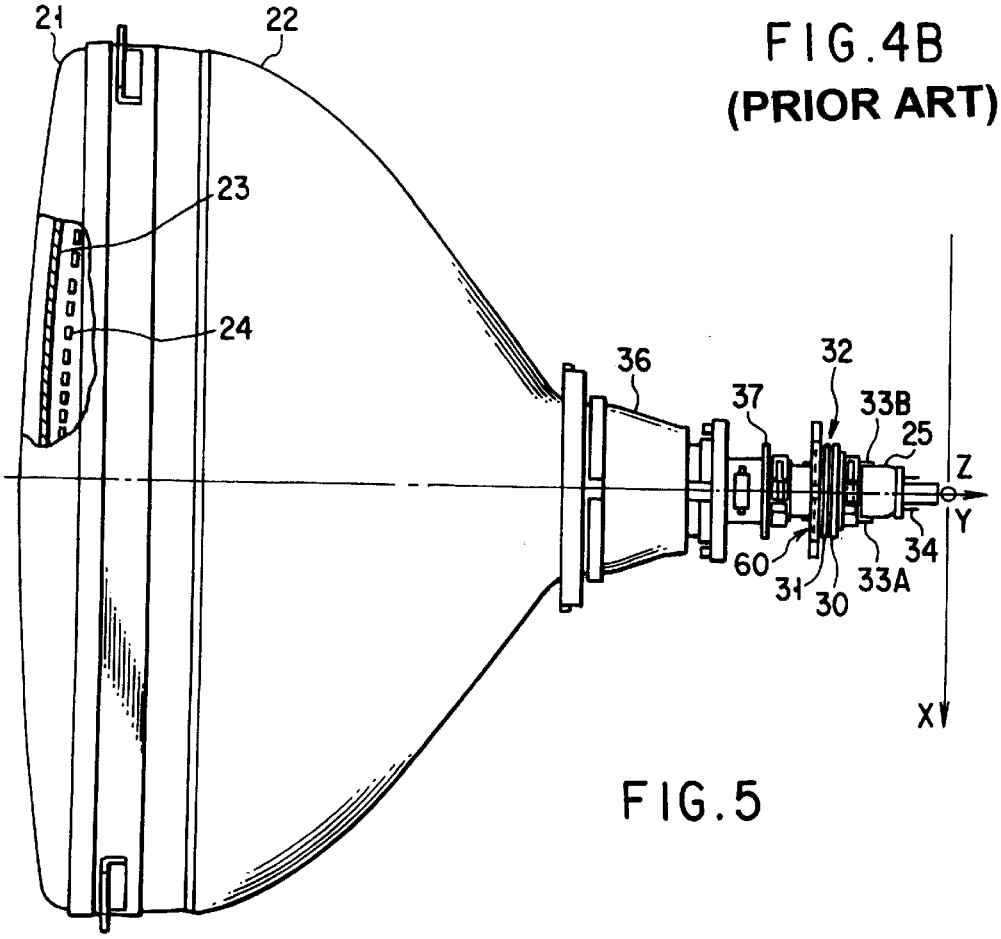
FIG. 5 is a schematic lateral view of an in-line type color cathode ray tube according to the invention, showing its overall configuration.
Figure 6:
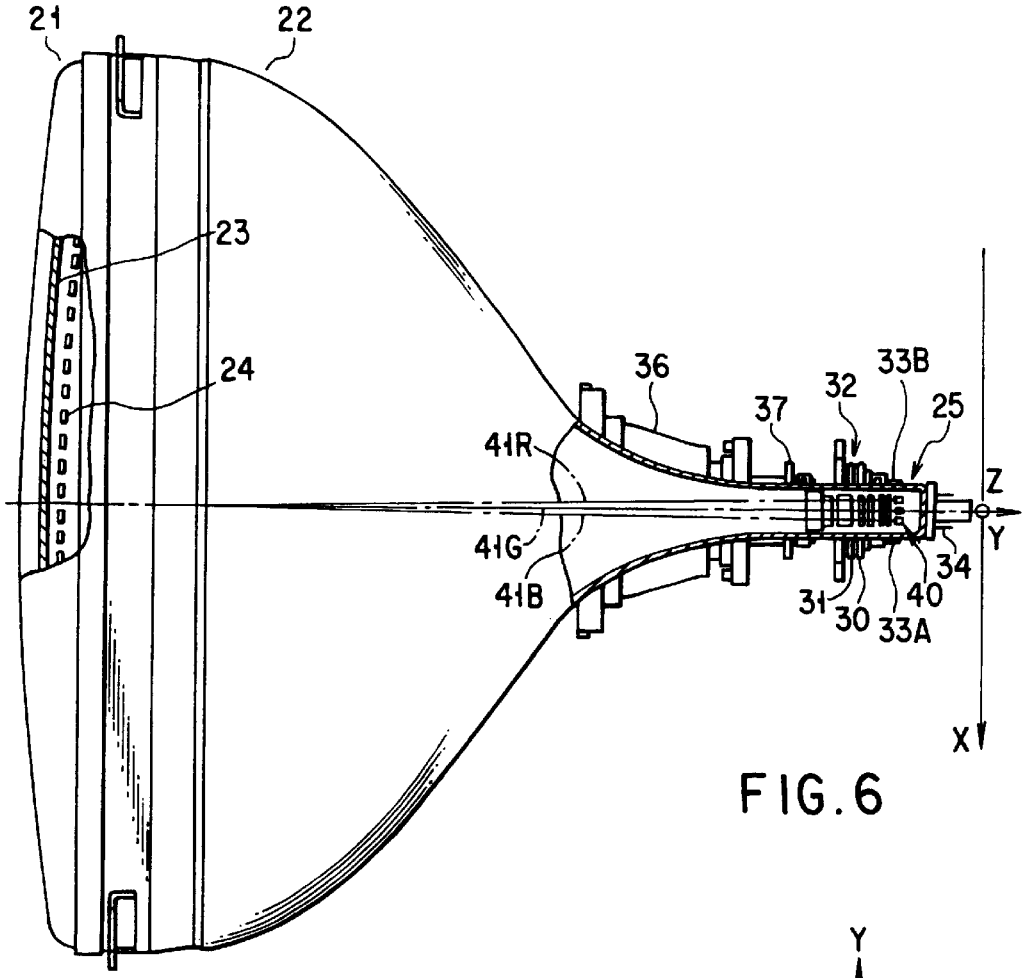
FIG. 6 is a schematic lateral view of the in-line type color cathode ray tube of FIG. 5, showing schematically the structure of the electron gun arranged in the neck of the color cathode ray tube.

Referring to FIGS. 5 and 6, the embodiment of in-line type color cathode ray tube comprises an envelope including a panel 21, a funnel 22 connected to the panel 21 and a neck 25 having a reduced diameter and connected to the funnel 22. A fluorescent screen 23 is arranged on the inner surface of the panel 21, said fluorescent screen 23 having three layers of red (R), green (G) and blue (B) fluorescent materials laid on the inner surface of the panel 21. Additionally, a shadow mask 24 is arranged vis-a-vis the fluorescent screen 3 in close vicinity and provided with a number of apertures for allowing electron beams to pass therethrough.

As shown in FIG. 6, an in-line type electron gun assembly 40 is arranged in the neck 25 of the envelope at a position on the horizontal axis, or X-axis, of the tube and adapted to emit three electron beams. The in-line type electron gun assembly 40 is provided with three cathodes arranged in a single line and having respective built-in heaters and also with a plurality of electrodes for controlling, converging and accelerating the electron beams emitted from the cathodes, each of the electrodes being rigidly secured by an insulating support along with the related one of the cathodes. Stem pins 34 are arranged on the rear end of the neck 25 to feed the in-line type electron gun assembly 40 with a predetermined voltage.

A deflector 36 is arranged on part of the outer peripheral surface of the funnel 22 and that of the neck 25. The deflector 36 has a pair of saddle-type horizontal deflecting coils and a pair of saddle-type vertical deflecting coils. The horizontal deflecting coils are used to produce a deflection magnetic field in the form of a pin-cushion, whereas the vertical deflecting coils are used to produce a deflection magnetic field having a barrel-like form.

The three electron beams 41R, 41G and 41B emitted from the electron gun can be made to hit phosphor strip trios on the fluorescent screen 23 arranged on the inner surface of the panel 21 to realize self-convergence through a combined use the in-line type electron gun 40 and the deflector adapted to produce a non-uniform magnetic fields.

A pair of oppositely disposed ring-shaped dipole magnets 37, each having an N-pole and an S-pole, are arranged on the rear end of the deflector 36. The magnetic fields produced by the dipole magnets 37 correct the axial displacements of the electron beams, or the angular displacements of the angles of incidence of the electron beams striking the shadow mask such that the electron beams may hit the respective stripes of the fluorescent materials that are arranged on the fluorescent screen to provide their targets. In other words, the dipole magnets are used to regulate the landing beams.

Figure 7:
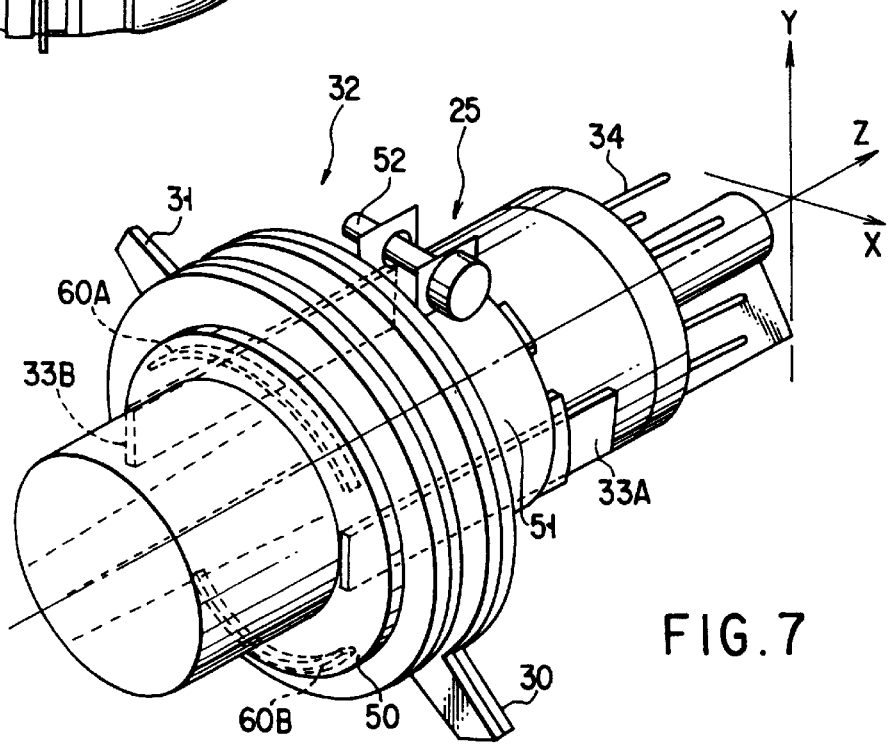
FIG. 7 is a schematic perspective view of the convergence magnet of the in-line type color cathode ray tube of FIG. 5.

A convergence magnet 32 is arranged on the outer peripheral surface of the neck 25 between the dipole magnets 37 and the rear end of the neck 25 as shown in FIGS. 6 and 7. The convergence magnet 32 comprises at least a pair of ring-shaped magnet plates 31 for generating a quadrupole magnetic field with two pairs of N- and an S-poles and another pair of ring-shaped magnet plates 30 for generating a hexapole static magnetic field with three pairs of N- and S-poles. The magnetic fields generated by the quadrupole magnet plates 31 and the hexapole magnet plates 30 affect particularly the side beams of the three electron beams horizontally and vertically in such a way that the side beams of the red electron beam 41R and the blue electron beam 41B are regulated and evenly arranged at the opposite lateral sides of the center beam of the green electron beam 41G.

Thus, the dipole magnets 37 and the convergence magnet 32 regulate the three electron beams such that the three electron beams emitted from the electron gun in a single array are converged to the center of the fluorescent screen 23 to achieve a satisfactory level of color purity and convergence.

The three electron beams are then deflected by the deflector 36 to scan the fluorescent screen to reproduce the transmitted color image on the fluorescent screen 23.

A first pair of elongated magnets 33*a*, 33B are arranged outside the neck oppositely relative to each other on the X-axis of the neck 25 and extending along the Z-axis in order to shield the electron beams against the external magnetic field such as the geomagnetism that can adversely affect the electron beams as shown in FIG. 7.

The convergence magnet 32 comprises ring-shaped magnet plates fitted to a cylindrical holder 50, which is by turn fitted to the neck 25, in order to generate static magnetic fields. The convergence magnet 32 of FIG. 7 has at least a pair of hexapole magnet plates 30 and a pair of quadrupole magnet plates 31.

More specifically, with the convergence magnet 32 comprising a pair of hexapole magnet plates 30 and a pair of quadrupole magnet plates 31, when the ears of the paired hexapole magnet plates 30 for regulating the angular displacement of the corresponding poles are aligned, the magnetic fields of the magnet plates offset each other to minimize the intensity of the magnetic field produced by the magnet. Similarly, when the ears of the paired quadrupole magnet plates 31 for regulating the angular displacement of the corresponding poles are aligned, the magnetic fields of the magnet plates offset each other to minimize the intensity of the magnetic field produced by the magnet. The intensity of the magnetic field generated by the quadrupole magnet plates 31 will be maximized when they are angularly displaced by 90°. On the other hand, the intensity of the magnetic field generated by the hexapole magnet plates 30 will be maximized when they are angularly displaced by 60°.

Of the above described convergence magnet 32, the paired hexapole magnet plates 30, the paired quadrupole magnet plate 31 and an anchor ring are arranged from the side of the stem pins in the above mentioned order on the cylindrical holder 50. A first spacer is arranged between the hexapole magnet plates 30 and the quadrupole magnet plates 31 and a second spacer is arranged between the quadrupole magnet plates and the anchor ring.

The convergence magnet 32 having the above described configuration is then rigidly secured to the neck 25 by means of a fastening belt 51 and a clamp screw 52 at an end of the holder 50.

The first magnets 33A, 33B are rigidly secured along the X-axis onto the inner surface of the cylindrical holder 50.

With the above described embodiment, the first magnets 33A, 33B are made of a cold rolled silicon steel plate and typically has a height of 0.35 mm, a length of 35 mm and a width of 4 mm.

As shown in FIG. 7, a second pair of magnets 60A, 60B are arranged on the inner surface of the holder 50 and in the X-Y plane symmetrically relative to the Y-axis at a position separated from the hexapole magnet plate 30 along the Z-axis by 0.5 mm. The second magnets 60A, 60B are also made of a cold rolled silicon steel plate having a radius of curvature substantially same as that of the inner periphery of the hexapole magnet plate 30 and typically has a height of 0.25 mm and a width of 2.5 mm.

Figure 8:
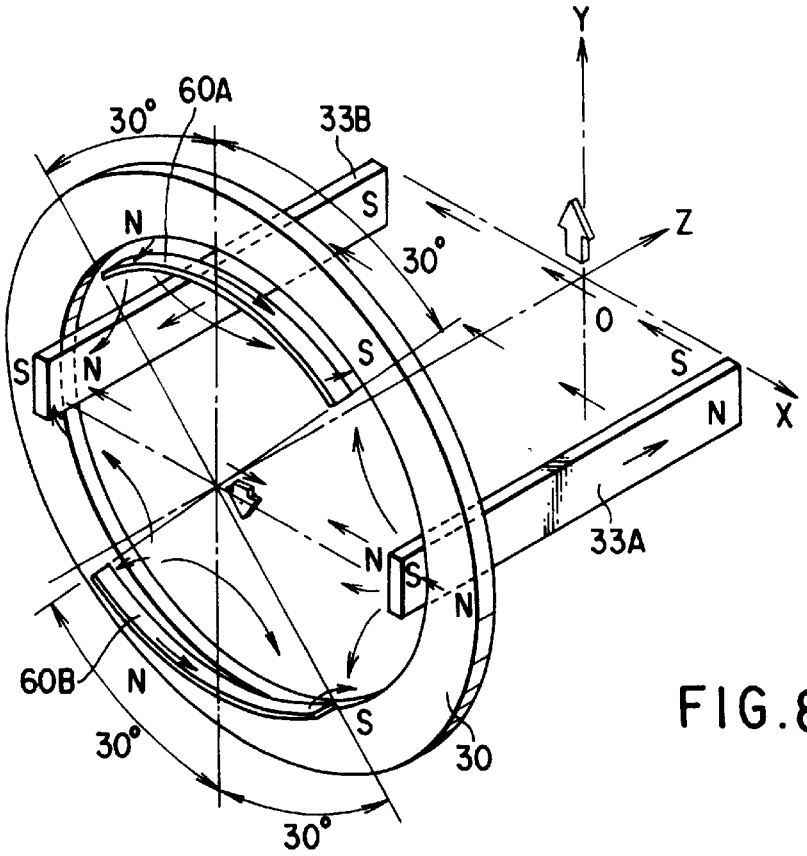
FIG. 8 is a schematic perspective view of the convergence magnet and the first and second magnets of FIG. 7, showing their positional relationship.

FIG. 8 is a schematic perspective view of the hexapole magnet plate and the first and second pairs of magnets 33A, 33B, 60A, 60B, showing their positional relationship when the electron beams are subjected to a force indicated by a big arrow directed toward the positive side of the Y-axis for track correction. Referring to FIG. 8, the positive sides of the X-, Y- and Z-axes are indicated by thin arrows and the negative sides are the sides opposite to the respective positive sides.

Note that the hexapole magnet plate 30 are arranged such that one of the N-poles and one of the S-poles of the hexapole magnet plate 30 are located vis-a-vis on the horizontal axis, or X-axis. Then, the front ends, or the ends directed to the negative side of the Z-axis, of the first pair of magnets 33A, 33B are located respectively close to the above N- and S-poles. Therefore, the areas of the first pair of magnets 33A, 33B located close to the respective poles of the hexapole magnet plate 30 will be magnetized to show polarities opposite to those of the corresponding poles of the hexapole magnet plate 30. The first pair of magnets are magnetized in the longitudinal direction along the Z-axis as a whole so that consequently, a dipole magnetic field will be generated both at the front end, or the end at the negative side of the Z-axis, and at the rear end, or the end at the positive side of the Z-axis, of each of the first pair of magnets.

More specifically, an S-pole is produced in an area of the surface, facing the corresponding N-pole of the hexapole magnet plate 30, of the first magnet 33A which is located at the positive side of the X-axis, while an N-pole is produced both at the front end and at the rear end of the first magnet 33A. Similarly, an N-pole is produced in an area of the surface, facing the corresponding S-pole of the hexapole magnet plate 30, of the first magnet 33B which is located at the negative side of the X-axis, while an S-pole is produced both at the front end and at the rear end of the first magnet 33B.

As a result, a magnetic field directed from the magnet 33A toward the magnet 33B, or from the positive side toward the negative side of the X-axis, at the rear ends of the paired magnets 33A, 33B. Thus, the electron beams passing by the rear ends of the first pair of magnets 33A, 33B are subjected to an upward force along the Y-axis.

On the other hand, since the magnetic flux of the poles located on the X-axis in and near the plane of the hexapole magnet plate 30 are guided by the first pair of magnets 33A, 33B, the intensity of the magnetic field produced by the hexapole magnet plate 30 and directed from the positive side toward the negative side of the X-axis is reduced.

Additionally, the second pair of magnets 60A, 60B arranged along the inner periphery of the hexapole magnet plate 30 produces four poles at the opposite sides of the Y-axis but the magnetic field produced by the four poles and directed from the negative side toward the positive side of the X-axis will be bypassed. Thus, of the magnetic fields produced by the four poles near the Y-axis, the one intersecting the track of the center beam and directed from the negative side toward the positive side of the Y-axis will be damped to reduce its intensity.

Therefore, as a result of arranging the first pair of magnets 33A, 33B and the second pair of magnets 60A, 60B close to the hexapole magnet plate 30, the intensity of the magnetic field produced by the two poles on the horizontal axis and directed from the positive side toward the negative side of the X-axis will be reduced and that of the magnetic field produced by the four poles near the Y-axis and directed from the negative side toward the positive side of the X-axis will also be reduced. Thus, out of the magnetic fields produced by the hexapole magnet plate 30, those that affect the center beam on its proper locus will be damped to reduce its intensity practically close to zero.

Therefore, while the hexapole magnet plate 30 is designed to offset the effect of the magnetic fields of the two poles on the horizontal axis and that of the magnetic fields of the four poles near the Y-axis are offset to produce a zero magnetic field intensity on the locus of the center beam when the first and second pairs of magnets 33A, 33B, 60A, 60B are not provided, the effect of the magnetic fields on the locus of the center beam is practically reduced to zero after arranging the first and second pairs of magnets 33A, 33B, 60A, 60B in position. Thus, any significant displacement of the center beam can be prevented from taking place when the six poles are corrected after regulating the landing beams by means of the dipole magnets so that the landing beams do not have to be regulated for another time by means of the dipole magnets.

Figure 9:
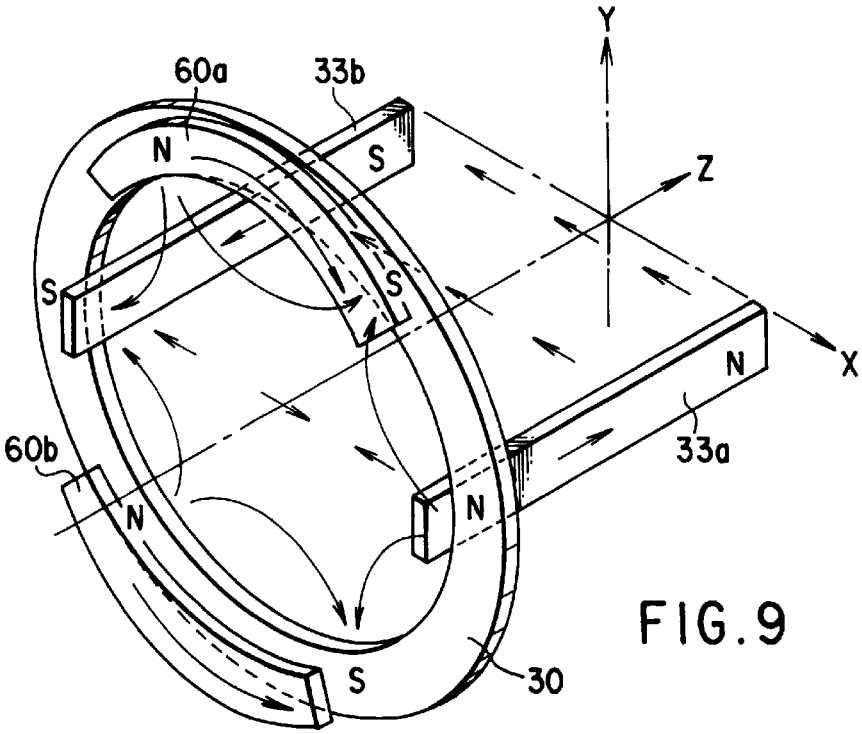
FIG. 9 is a schematic perspective view similar to FIG. 8 but showing modified first and second magnets and their positional arrangement.

While the second pair of magnets 60A, 60B in FIG. 8 are plate-shaped and arranged along the inner periphery of the hexapole magnet plate 30, those of FIG. 9 are realized in the form of arcuate rods, which may be arranged vis-a-vis or in contact with the outer surface of the ring-shaped hexapole magnet plate 30. With the use of arcuate rod-shaped second pair of magnets 60A, 60B as shown in FIG. 9, the intensity of the magnetic field produced by the two poles on the horizontal axis and directed from the positive side toward the negative side of the X-axis will be reduced and that of the magnetic field produced by the four poles near the Y-axis and directed from the negative side toward the positive side of the X-axis will also be reduced. Thus, out of the magnetic fields produced by the hexapole magnet plate 30, those that affect the center beam on its proper track will be damped to reduce its intensity practically close to zero. The second pair of magnets 60A, 60B as shown in FIG. 8 or 9, be they plate-shaped or rod-shaped, preferably have a radius of curvature equal to that of the inner periphery of the magnet plate 30.

Figure 10:
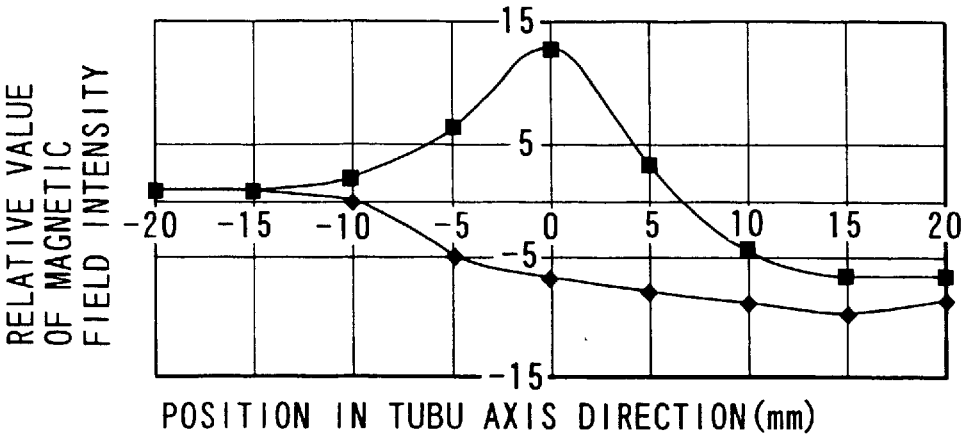
FIG. 10 is a graph showing the horizontal distribution of the intensity of the magnetic field on the tracks of the electron beams of a known in-line type color cathode ray tube.
Figure 11:
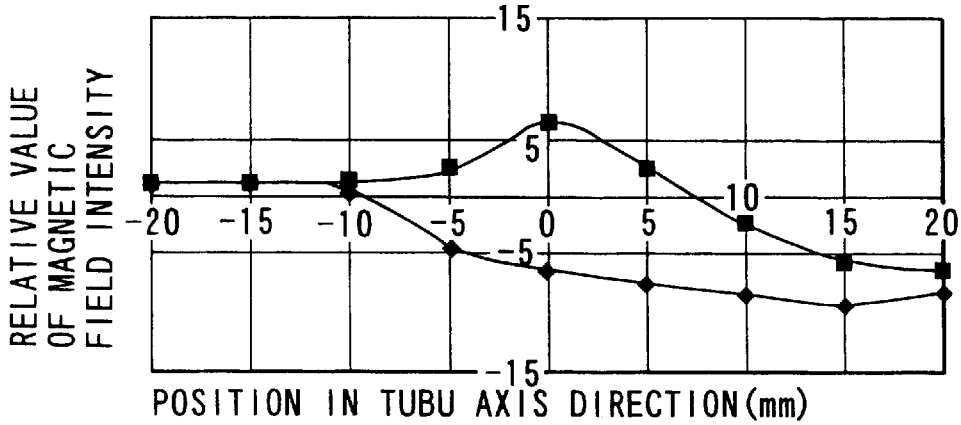
FIG. 11 is a graph showing the horizontal distribution of the intensity of the magnetic field on the tracks of the electron beams of an in-line type color cathode ray tube according to the invention.

FIG. 10 is a graph showing the horizontal distribution of the intensity of the magnetic field on the tracks of the three electron beams arranged in array of a known color cathode ray tube. FIG. 11 is a graph showing the horizontal distribution of the intensity of the magnetic field on the tracks of the three electron beams arrange in array of the above embodiment of color cathode ray tube according to the invention.

In the graphs of FIGS. 10 and 11, the horizontal axis represents the axis of the tube or the Z-axis, where 0 stands for the center of the hexapole magnet plate and the negative side and the positive side respectively stand for the deflector side and the side of the stem pins. The vertical axis represents the relative intensity of the magnetic field of the center beam on its track and that of the magnetic field of each of the side beams also on its track. Note that the positive side of the vertical axis indicates a magnetic field directed to the positive side of the X-axis, whereas the negative side of the vertical axis indicates a magnetic field directed to the negative side of the X-axis.

Referring to FIGS. 10 and 11, the integral of each of the magnetic field intensity distribution curves indicates the intensity of the magnetic field affecting the corresponding electron beam, that determines the displacement of the electron beam along the Y-axis.

The graph in FIG. 10 is for a convergence magnet provided only with a first pair of magnets, the front ends of which are located close to the hexapole magnet plate. With this arrangement, a negative magnetic field is produced on the track of the center beam and that of each of the side beams in an area on the side of the stem pins where the first pair of magnets are arranged and a strong magnetic field is produced on the track of the center beam in a forward area from a location close to the hexapole magnet plate. Since the intensity of the positive magnetic field is relatively high on the center beam, the center beam if subjected to a force directed downward or toward the negative side of the Y-axis. Therefore, the intensity of the positive magnetic field has to be reduced to reduce the displacement of the center beam.

The graph in FIG. 11 is for a convergence magnet provided with a first pair of magnets and a second pair of magnets as shown in FIG. 8. With this arrangement, any positive magnetic field is damped to reduce its intensity near the hexapole magnet plate under the effect of the second pair of magnets and the positive and negative components of the magnetic field on the track of the center beam are offset. As a result, the combined force affecting the center beam will be minimized.

With this embodiment, the displacement of the two side electron beams is 1.3 mm to the positive side in the direction of the Y-axis and that of the center electron beam is 0.2 mm to the negative side in the direction of the Y-axis. Then, the displacement of the landing beams is 2 $\mu$m, which is found within the tolerable limit for regulation errors.

This improvement is brought forth by that the magnetic fields produced by the four poles near the Y-axis are bypassed to the adjacent poles by the second pairs of magnets. Thus, the magnetic field produced by the hexapole magnet plate to affect the locus of the center beam and directed from the negative side toward the positive side along the X-axis is offset by the magnetic field directed from the positive side toward the negative side along the X-axis. Therefore, the intensity of the magnetic fields can be regulated by controlling the height, the magnetic permeability and the width of the second pair of magnets.

Japanese Patent Application Laid-Open No. 7-250335 discloses the use of a ring-shaped magnet arranged in the vicinity of the hexapole magnet plate and hence brings about the effect of regulating the intensities of the six magnetic fields produced by the six poles. However, with the technique of the above patent application, the intensities of the magnetic fields can be reduced on the loci of the two side beams because the ring-shaped magnet covers the entire zone through which the electron beams pass.

Figure 12:
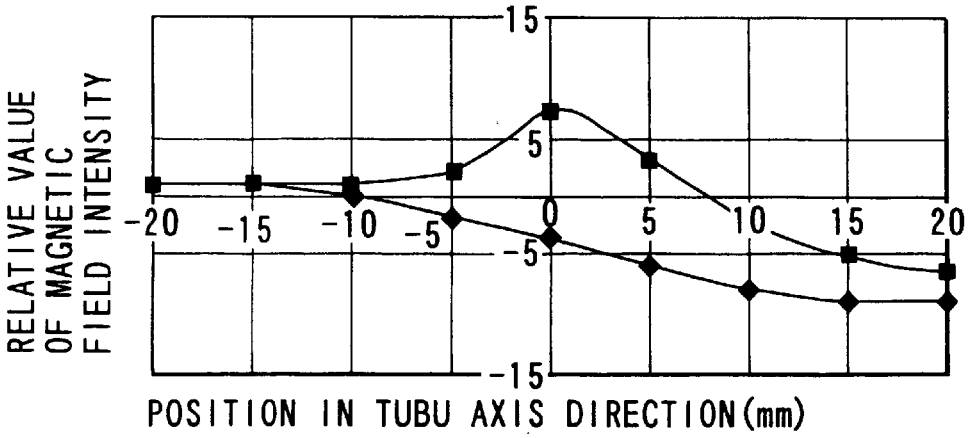
FIG. 12 is a graph showing the horizontal distribution of the intensity of the magnetic field on the tracks of the electron beams of another known in-line type color cathode ray tube.

FIG. 12 is a graph showing the horizontal distribution of the intensity of the magnetic field on the tracks of the electron beams of an in-line type color cathode ray tube disclosed by Japanese Patent Application Laid-Open No. 7-250335. As shown, the magnetic fields on the loci of the two side beams are damped along with the magnetic field that is directed positively on the track of the center beam. When magnets with a same magnetic force are used, while the displacement of the center beam can be reduced to 0.2 mm toward the negative side in the direction of the Y-axis, that of the two side beams is also reduced to 0.6 mm.

In other words, in order to correct the loci of the two side beams by a required amount, the intensity of the magnetic field of the magnet plate has to be increased. The intensity of the magnetic field of the magnet plate can be increased only by redesigning the latter and typically raising the content of the magnetic powder of the plastic magnet used for the magnet plate.

Therefore, the use of a ring-shaped second magnet arranged in the vicinity of the hexapole magnet plate as disclosed in Japanese Patent Application Laid-Open No. 7-250335 is not an optimal choice.

Figure 13:
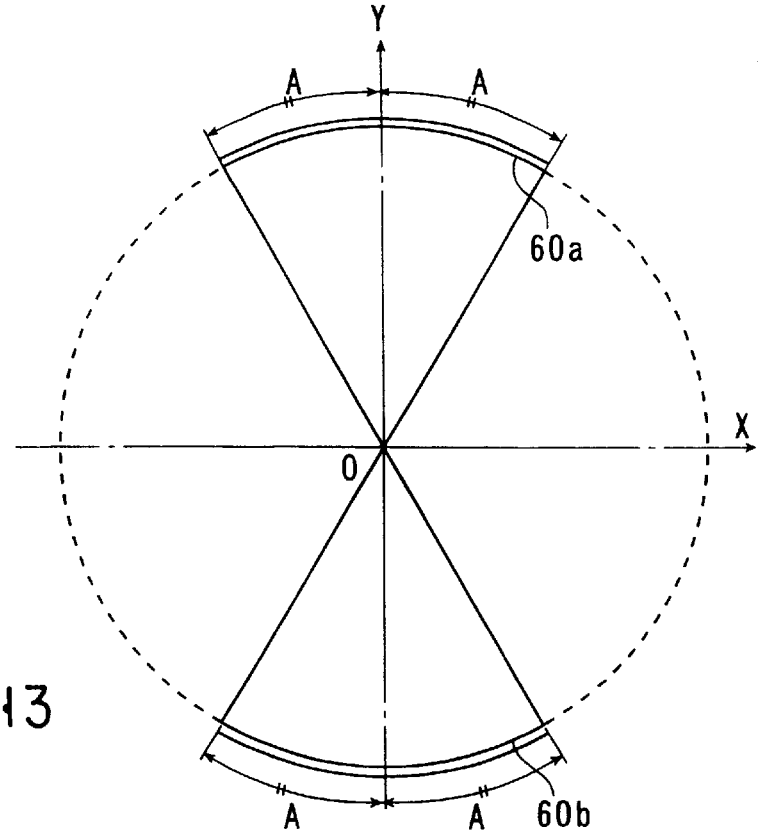
FIG. 13 is a schematic illustration of the second pair of magnets, showing their angular areas.

In a color cathode ray tube according to the invention as shown in FIG. 13, a second pair of magnets 60A, 60B having a radius of curvature equal to that of the inner periphery of the hexapole magnet plate are arranged only in the vicinity of the Y-axis. The hexapole magnet plate 30 is realized in the form of a ring having a circular inner periphery with the center of circle located at the point of intersection O of the X-axis and the Y-axis and the second pair of magnets 60A, 60B are arranged along the circular inner periphery. The second pair of magnets 60A, 60B are arranged symmetrically relative to the point of intersection O to cover a certain angle of A. The arcuate length of the second pair of magnets 60A, 60B is proportional to the angle they occupy at the point of intersection O.

Figure 14:
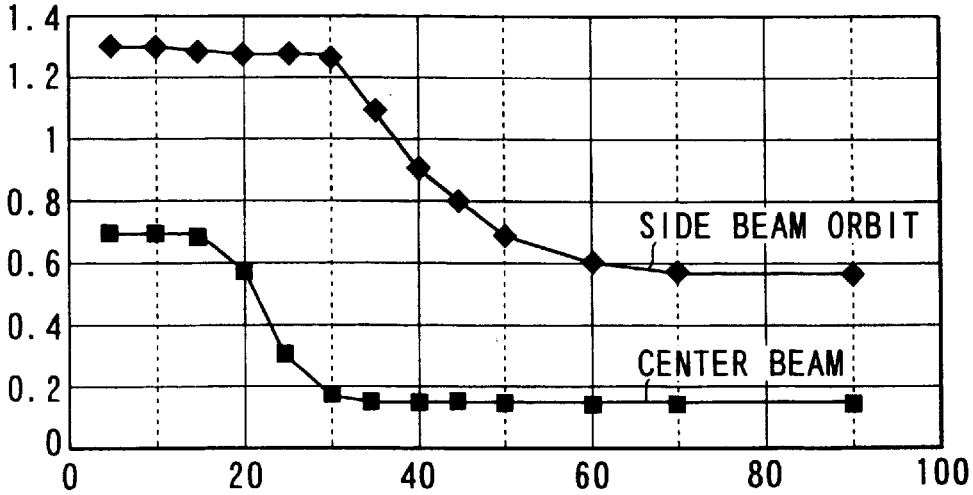
FIG. 14 is a graph showing the relationship between the angular areas of the magnets and the displacement of the center beam and that of the side beams.

FIG. 14 is a graph showing the relationship between the angular areas of the second pair of magnets and the displacement of the center beam and that of the side beams. The horizontal axis of the graph represents the angle occupied by each of the magnets at each side of the Y-axis. Therefore, the angle occupied by each of the second pair of magnets is equal to A multiplied by two.

Referring to FIG. 14, the displacement of the center beam starts decreasing when the angle occupied by the second pair of magnets gets to about 20 degrees and falls to about 0.3 mm, which is found within the permissible range, when the angle exceeds 25 degrees. On the other hand, the displacement of the two side beams starts decreasing when the angle gets to about 30 degrees and reduced by about 50% when the angle is about 50 degrees to realize a condition where the second pair of magnets are virtually non-existent.

Thus, in order to suppress the displacement of the center beam to less than 0.3 mm and minimize the reduction in the displacement of the side beams, the angle A occupied by the second pair of magnets is preferably between 25 degrees and 40 degrees, more preferably about 30 degrees.

As described above in detail, in a color cathode ray tube according to the invention, a second pair of magnets is disposed symmetrically near the vertical axis along the inner periphery of the hexapole magnet plate to correct the vertical displacement of the electron beams at the time of installing magnets in addition to a first pair of magnets arranged oppositely to shut off any external magnetic fields affecting the electron beams. The second pair of magnets have a radius of curvature substantially same as that of the inner periphery of the hexapole magnet plate and cover an angular area corresponding to a central angle between 25 degrees and 40 degrees at each side of the vertical axis. Thus, any magnetic fields produced near the vertical axis and directed toward the center beam are bypassed so that the magnetic field affecting the center beam can be suppressed without damping the magnetic field affecting the two side beams. Therefore, the arrangement of the second pair of magnets does not affect the center beam and only exerts a vertical force on the side beams.

As a result the controllability of the convergence magnet is improved and any displacement of the center beam during the operation of regulating the hexapole magnet plate after regulating the landing beams by means of dipole magnets can be effectively prevented to eliminate the need of regulating the landing beams for another time by means of dipole magnets. Thus, an in-line type color cathode ray tube according to the invention provide an enhanced level of regulating efficiency.

As described above in detail, the present invention provide a color cathode ray tube showing a good level of operability and regulating efficiency.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. A color cathode ray tube comprising:

an envelope having a tube axis and including a panel having an inner surface on which a phosphor screen is formed, a funnel connected to the panel and neck connected the funnel;

an electron gun assembly, arranged in said neck, for emitting in-line three electron beams toward said phosphor screen;

convergence magnet structure arranged outside of said neck, for generating a hexapole magnetic field in the neck;

a first pair of magnetic members arranged outside of the neck on a horizontal axis, faced to each other with said electron gun assembly interposed therebetween and extending along the axis of the tube; and a second pair of magnetic members so arranged in the X-Y plane as to face to each other on a Y-axis and elongated along the magnet structure, respectively, the X-axis corresponding to said horizontal axis, the Y-axis corresponding to a vertical axis normal to said horizontal axis and the tube, axis and the X-Y plane being defined by the X- and Y-axis.

2. A color cathode ray tube according to claim 1, wherein said second pair of magnetic members has a radius of curvature substantially equal that of the inner periphery of the magnet structure.

3. A color cathode ray tube according to claim 1, wherein said first pair of magnetic members extending in the direction of the axis of the tube are adapted to regulate the horizontal component of the external magnetic field affecting the two side electron beams of said three electron beams.

4. A color cathode ray tube according to claim 1, wherein said second pair of magnetic members are arranged on the outer surface of said neck.

5. A color cathode ray tube according to claim 1, wherein said second pair of magnetic members are arranged integrally with said convergence magnet plates.

6. A color cathode ray tube according to claim 1, wherein said convergence magnet structure comprises a cylindrical holder, a ring-shaped first magnet plate for generating a quadrupole magnetic field, a ring-shaped second magnet plate for generating a hexapole magnetic field and a spacer disposed between said first and second magnet plates and said second pair of magnets are arranged oppositely on the inner surface of said cylindrical holder.

7. A color cathode ray tube comprising:

an envelope having a tube axis and including a panel having an inner surface on which a phosphor screen is formed, a funnel connected to the panel and neck connected the funnel;

an electron gun assembly arranged in said neck, for emitting in-line of electron beams toward said phosphor screen;

an convergence magnet structure arranged outside of said neck, for generating a hexapole magnetic field in the neck;

a first pair of magnetic members arranged outside of said neck on a horizontal axis, faced to each other with said electron gun interposed therebetween and extending along the axis of the tube; and a second pair of magnetic members so arranged in the X-Y plane as to face to each other on a Y-axis each having a shape being symmetrically relative to the X-Z plane and elongated along the magnet structure within an angle between 25° and 40° of a circle with the center located on the tube axis in the X-Y plane, the X-axis corresponding to said horizontal axis, the Y-axis corresponding to a vertical normal to said horizontal axis and said tube axis, a Z-axis corresponding to the tube axis, the center being defined as the point of intersection of the X-, Y- and Z-axes.

8. A color cathode ray tube according to claim 7, wherein said first pair of magnetic members extending in the direction of the axis of the tube are adapted to regulate the horizontal component of the external magnetic field affecting the two side electron beams of said three electron beams.

9. A color cathode ray tube according to claim 7, wherein said second pair of magnetic members are arranged on the outer surface of said neck.

10. A color cathode ray tube according to claim 7, wherein said second pair of magnetic members are arranged integrally with said convergence magnet structure.

11. A color cathode ray tube according to claim 7, wherein said convergence magnet structure comprises a cylindrical holder, a ring-shaped first magnet plate for generating a quadrupole magnetic field, a ring-shaped second magnet plate for generating a hexapole magnetic field and a spacer disposed between said first and second magnet plates and said second pair of magnets are arranged oppositely on the inner surface of said cylindrical holder.

* * * * *